US008678987B2

(12) United States Patent
Henne

(10) Patent No.: US 8,678,987 B2
(45) Date of Patent: Mar. 25, 2014

(54) CENTRIFUGE WITH A COUPLING ELEMENT FOR AXIALLY LOCKING A ROTOR

(75) Inventor: Sebastian Henne, Göttingen (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 13/059,989

(22) PCT Filed: Sep. 3, 2009

(86) PCT No.: PCT/EP2009/006398

§ 371 (c)(1), (2), (4) Date: May 23, 2011

(87) PCT Pub. No.: WO2010/025922

PCT Pub. Date: Mar. 11, 2010

(65) Prior Publication Data

US 2011/0212822 A1 Sep. 1, 2011

(30) Foreign Application Priority Data

Sep. 3, 2008 (DE) ..... 10 2008 045 556

(51) Int. Cl.
*B04B 7/06* (2006.01)

(52) U.S. Cl.
USPC ..... 494/12; 494/16; 494/84

(58) Field of Classification Search
USPC ..... 494/12, 16, 20, 33, 64, 84, 85; 210/232
See application file for complete search history.

(56) References Cited

U.S. PATENT DOCUMENTS 3,779,451 A * 12/1973 Lehman ..... 494/16
4,753,631 A * 6/1988 Romanauskas ..... 494/9

(Continued)

FOREIGN PATENT DOCUMENTS

| | | | |
|---|---|---|---|
| DE | 2 251 614 A1 | | 5/1973 |
| DE | 199 30 593 A1 | | 4/2000 |
| DE | 199 02 645 A1 | | 7/2000 |
| FR | 2951965 | * | 5/2011 |
| JP | 2010142696 A | * | 7/2010 |

OTHER PUBLICATIONS

European Patent Office, International Search Report and Written Opinion of the International Searching Authority, International Application No. PCT/EP2009/006398, mailed Nov. 27, 2009, 12 pages.

(Continued)

*Primary Examiner* — Charles E Cooley
(74) *Attorney, Agent, or Firm* — Wood, Herron & Evans, LLP

(57) ABSTRACT

The invention relates to a centrifuge with a drive head which can be connected with a drive, a rotor which can detachably be mounted on the drive head, at least one connection element with which the drive head can be connected in a torsion-proof manner with the rotor, and at least one coupling element which is attached to the drive head and is able to exert an axial force on the rotor in such a way that the rotor can be fixed axially, with the axial force increasing with the rising rotational speed of the drive head, with the coupling element on the rotor transmitting the axial force by means of a ramp surface which is inclined at an angle (α) relative to the horizontal line in a range of more than 0° to 15°. Secure locking of the rotor during standstill and high speeds can thus be achieved.

11 Claims, 3 Drawing Sheets

(56) References Cited

U.S. PATENT DOCUMENTS

| | | | | |
|---|---|---|---|---|
| 5,342,282 | A * | 8/1994 | Letourneur | 494/82 |
| 5,443,438 | A * | 8/1995 | Wright et al. | 494/84 |
| 5,681,257 | A * | 10/1997 | Letourneur | 494/12 |
| 6,063,018 | A * | 5/2000 | Letourneur | 494/12 |
| 6,149,571 | A * | 11/2000 | Okada et al. | 494/20 |
| 6,183,408 | B1 * | 2/2001 | Wright et al. | 494/82 |
| 2011/0212822 | A1 * | 9/2011 | Henne | 494/84 |

OTHER PUBLICATIONS

European Patent Office, International Preliminary Report on Patentability and Written Opinion of the International Searching Authority, International Application No. PCT/EP2009/006398, mailed Nov. 27, 2009 (7 pages).

* cited by examiner

CENTRIFUGE WITH A COUPLING ELEMENT FOR AXIALLY LOCKING A ROTOR

FIELD OF THE INVENTION

The present invention relates to a centrifuge with a drive head which can be connected with a drive, a rotor which can detachably be mounted on the drive head, at least one connection element with which the drive head can be connected in a torsion-proof manner with the rotor, and at least one coupling element which is attached to the drive head and is able to exert an axial force on the rotor in such a way that the rotor can be fixed axially, with the axial force increasing with the rising rotational speed of the drive head.

BACKGROUND OF THE INVENTION

A centrifuge can receive containers for samples and can be used for separating components of the samples contained therein at high rotational speed of a centrifuge rotor. In the case of a floor-stand centrifuge which is arranged on the floor and has a height which reaches up to a worktable, there is a fair amount of space for the components of the device. In the case of a desktop centrifuge however which is arranged on worktable, a low overall height is desired so that the available space within the centrifuge needs to be utilized well. This leads to the consequence that the upper side of a centrifuge rotor is disposed relatively close to the cover of the centrifuge. If this distance is smaller than the distance of the bottom side of the rotor to the floor of the bowl of the centrifuge, the upper side of the rotor will be pulled more strongly to the cover than the bottom side of the rotor is pulled towards the floor of the bowl. This can be explained by Bernoulli's principle. This usually leads to the consequence that an upwardly directed force generally acts on the centrifuge rotor. Lifting force in the amount of 100 N can be generated at a rotational speed of approximately 6,000 rpm in a conventional centrifuge. This is promoted even further in that the upper side of the rotor mostly has a large planar surface which rotates only a few millimeters beneath the cover of the centrifuge, whereas the bottom side of the rotor has a rugged geometry in which an attraction force according to Bernoulli is produced only to a lower extent.

The aerodynamic influence can further be supplemented by a dynamic influence, e.g. as a result of an external impulse of the centrifuge. In the case of such an impulse, it may occur that the elastically held motor will incline to the side and axial forces will be generated which superimpose on the lifting force of the rotor.

In order to enable the control over the aerodynamic and dynamic influences, rigid locks are used in centrifuges according to the state-of-the-art. They reliably prevent any axial displacement of the rotor at high rotational speeds. The locks require special tools in order to attach them and release them again in a secure fashion, so that the mounting work before and after a centrifuging run requires a relatively large amount of time. Moreover, there are locks which act depending on the speed, so that during standstill or at low speed the rotor can be withdrawn from the drive head against a low amount of force. Such a lock will only work reliably if the lifting forces are always smaller than the locking forces. Such a configuration is not suitable for all combinations of rotor and centrifuge and is also difficult to calculate as a result of the difficult determinability of the lifting forces by dynamic influences.

It is thus an object to provide a centrifuge which ensures reliable locking against axial lifting forces acting against the centrifuge rotor during standstill, low and high rotational speeds, with the locking force increasing even further in the axial direction with the rising rotational speed of the centrifuge rotor. Furthermore, the rotor should be able to be mounted on and dismounted from the drive head in a very short period of time and without any special tools.

SUMMARY OF THE INVENTION

The centrifuge in accordance with the present invention comprises a drive head which can be connected with a drive, a rotor which can detachably be mounted on the drive head, at least one connection element with which the drive head can be connected with the rotor in a torsion-proof manner, and at least one coupling element which is attached to the drive head and is able to exert an axial force on the rotor in such a way that the rotor can be axially fixed, with also the axially directed force increasing with the rising rotational speed of the drive head as a result of the centrifugal force, with the coupling element on the rotor transmitting the axial force by means of a ramp surface which is inclined at an angle in relation to the horizontal line in a range of larger 0° to 15°.

The coupling element is able to cause a self-locking by means of a ramp surface inclined in such a way, so that the rotor is unable to unlock the coupling element during standstill, low or high rotational speed. Such an effect is especially advantageous during standstill because the user can make sure by an attempted withdrawal of the rotor from the drive head whether the rotor is also securely locked. During high rotational speed, the locking force increases as a result of the ramp surface because the axial force component also increases with increasing centrifugal force.

It is advantageous when the coupling element is pivotable about a swivel axis between an unlocking position in which it is swiveled inwardly into the drive head, as a result of which the rotor is unlocked with respect to the drive head, and between a locking position in which the coupling element with the ramp surface protrudes from a jacket surface of the drive head and transmits an axial force onto the rotor, as a result of which the rotor is locked with respect to the drive head. Due to the fact that the coupling element can be swiveled inwardly completely into the drive head, the ramp surface is unable to act on any surface of the rotor so that the rotor can be moved in the axial direction. It can thus be removed from the drive axis. The pivoting of the coupling element can be induced in a simple manner and without any special tool. There are only two positions for the coupling element, with the one position being an unlocking position for the removal or insertion of the rotor and the other position being a locking position for the secure fixing of the rotor even under occurring lifting forces. When the coupling element is pretensioned in a resilient fashion in such a way that it assumes the locking position during the standstill of the rotor, there is a high amount of security that the rotor will always be locked unless coupling elements are displaced to the unlocking position against the spring force.

In a further embodiment of the invention, the connection element is arranged in the swivel axis of the coupling element, with which the drive head can be connected with the rotor in a torsion-proof manner. Such a construction is advantageous because the connection element can assume the function of the swivel axis, so that only one component is required. This allows realizing a compact and light construction.

The coupling element can comprise a coupling tooth which is able to cooperate with an actuating element in such a way that a pivoting movement can be performed on the coupling element, so that a displacement of the coupling element from the locking position to the unlocking position and vice-versa can be performed. The coupling tooth can be a cam or a protrusion and is preferably integrally arranged with the coupling element. The contact surface of the coupling tooth with the actuating element can have a hardened surface, so that wear and tear of the coupling tooth is low in the case of frequent displacement to the unlocking position. In the case of a resiliently pretensioned coupling element, the actuating element only needs to overcome the spring force and optionally an adhesive force of the coupling element with the rotor.

The centrifuge can be arranged in such a way that the actuating element can be arranged in the rotary axis of the centrifuge and is arranged in a conical manner at one end, so that during axial displacement of the actuating element the conical end can interact with the protruding portion of the coupling element. The actuating element therefore only needs to be moved vertically, so that the wedge-shaped end comes into contact with the coupling tooth and is able to pivot the same to the side. The displacement of the coupling elements from the locking position to the release position can thus be performed very easily and without any tools.

In a further embodiment of the present invention, the axial force exerted by the coupling element acts on a sleeve which is fixedly mounted on the rotor. When the rotor is frequently placed on the drive head, wear and tear can occur on the contact surfaces of the rotor, so that the entire rotor would have to be exchanged. By inserting a sleeve between the rotor and the drive head, the sleeve can be exchanged very easily in case of wear and tear of the same, with the rotor being usable in an unchanged manner. Moreover, the sleeve can easily be mounted on the rotor by means of a screw connection or the like. Wear and tear can be prevented by coating the sleeve with Teflon.

In accordance with a further embodiment of the present invention, the drive head comprises a jacket surface having a cylindrical surface and the surface of a truncated cone, with the jacket surface resting in an interlocking manner on a corresponding holding surface of the rotor or the sleeve when the rotor or the sleeve are mounted with the drive head, with the cylindrical surface having a length which corresponds to at least one quarter of the length of the holding surface. In this embodiment the cylindrical surface is used for guiding the rotor of the sleeve, with the surface of the truncated cone being used predominantly as a stop surface in the axial direction during placement of the rotor on the drive head. The cylindrical surface can be produced very precisely with a low amount of production effort, so that precise guidance can be achieved. Guidance by the truncated cone on the other hand requires a considerable effort in production. Precise guidance can only be achieved with much difficulty. Tolerances in the shape, position and dimensions have a different effect on the centricity of guidance with a truncated cone and are also difficult to measure. An even contact pattern of a truncated cone can mostly only be achieved by grinding. The production and control effort can be reduced by avoiding guidance by the truncated cone and exclusive use of the cylindrical surface as the guide surface. The guidance precision increases with rising length of the cylindrical surface.

If the surface of the truncated cone has a cone angle of 15° up to 40° in relation to the rotary axis, dirt on the surface of the truncated cone has a very low effect. Any dirt or coating on the surface of the truncated cone leads to the consequence that the rotor or the sleeve will sit thereon at an earlier point in time than in the case of a clean surface of the truncated cone. The larger the truncated cone angle, the lower the height offset, so that the coupling elements can still be pivoted reliably to the locking position.

It is especially advantageous when the cylindrical surface or the truncated cone surface of the drive head comprises at least one recess, especially a transversal groove. As a result, during the vertical lowering of the rotor or the sleeve any existing coat of dirt on the cylindrical surface of the drive head can be stripped off downwardly and collect in this recess in the area of the cylindrical surface or the truncated cone surface. Thus a precise position of the rotor can be achieved despite the accumulation of dirt.

In a further embodiment of the present invention, the cylindrical surface of the drive head is arranged as a clearance fit in relation to the holding surface of the rotor or the sleeve, which clearance fit ensures secure guidance of the rotor during standstill and at a high rotary speed. A clearance fit can be produced relatively simply and at low cost.

BRIEF DESCRIPTION OF THE DRAWINGS

The invention is now described in closer detail by reference to an embodiment shown in the drawings, wherein.

The invention is now described in closer detail by reference to an embodiment shown in the drawings, wherein.

DETAILED DESCRIPTION OF THE INVENTION

Figure 1:
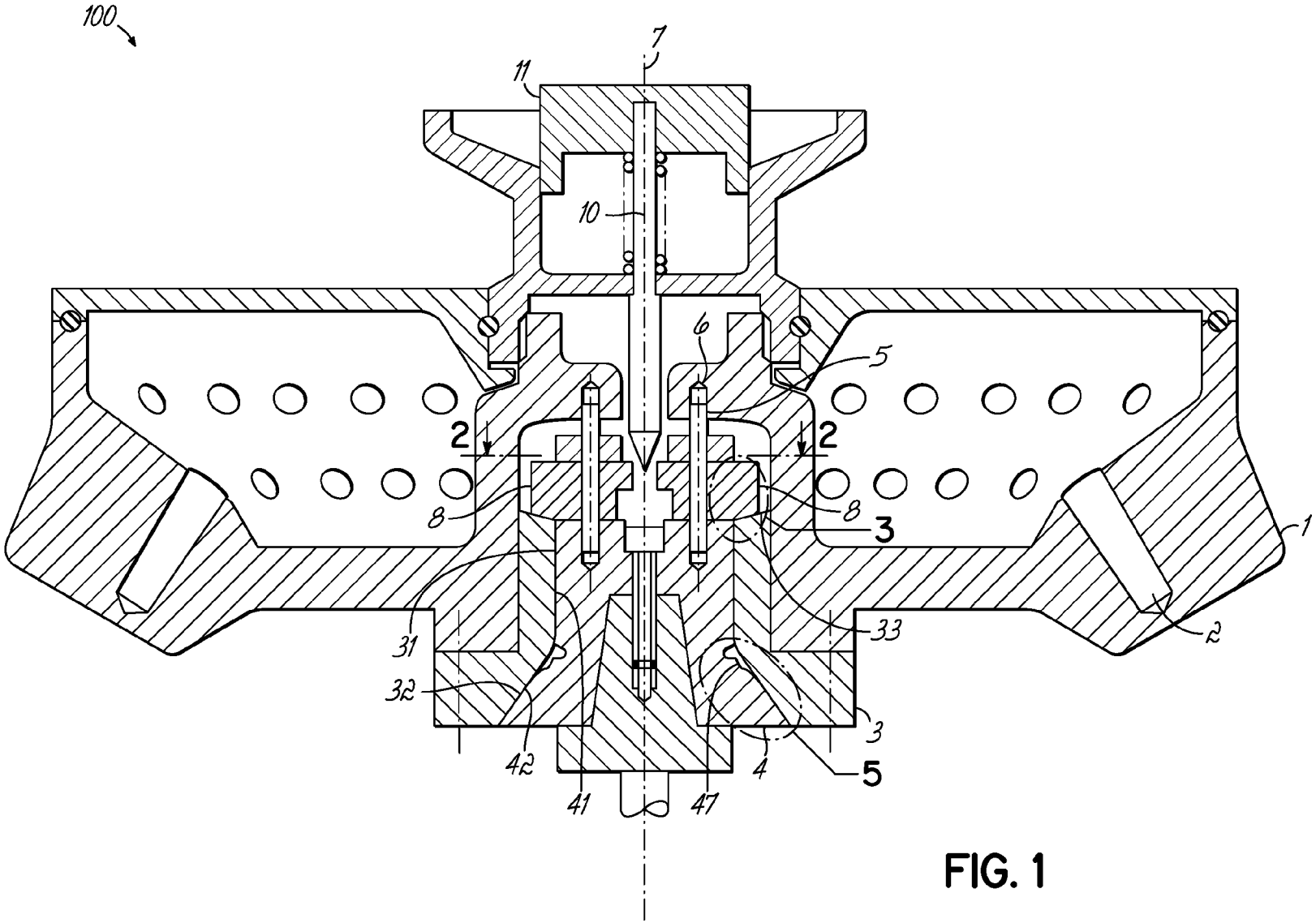
FIG. 1 shows a cross-sectional view of a centrifuge in accordance with the invention.

FIG. 1 shows a cross-sectional view of a centrifuge 100 in accordance with the invention without any substructure. Centrifuge 100 comprises a rotor 1 which comprises a plurality of recesses 2 for accommodating sample containers with substances to be centrifuged. A sleeve 3 is mounted on the rotor 1, which sleeve rests in an interlocking manner on a drive head 4. Two vertically extending connection elements 5 in the form of pins are attached to the drive head 4, which pins each engage in an interlocking manner in a recess 6 in rotor 1. In the embodiment as shown in FIG. 1 there are two connection elements 5 which are arranged symmetrically in relation to the rotary axis 7. It is also possible to provide more than two connection elements 5. During a rotary movement of the drive head 4 about the rotary axis 7, these connection elements 5 transmit a torque onto rotor 1, so that it can be made to rotate. It is achieved by the symmetric arrangement of the connection elements 5 that the torque is transmitted evenly onto the rotor 1.

Figure 2:
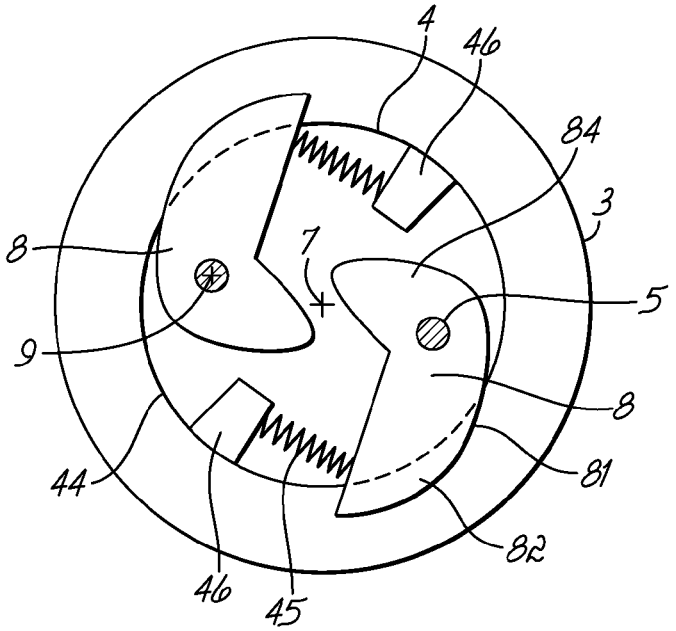
FIG. 2 shows a sectional view taken along line 2-2 in FIG. 1.

In addition, the centrifuge 100 comprises in this embodiment two coupling elements 8 which are each arranged symmetrically in relation to the rotary axis 7 (also see FIG. 2, which shows a view along the line of intersection A-A in FIG. 1). The coupling elements 8 are arranged on the drive head 4 and are able to pivot to the side. The swivel axis 9 is formed by the connection element 5.

When the rotor 1 is to be connected with the drive head 4, rotor 1 is moved downwardly from the top in the direction towards the drive head 4. The sleeve 3 which is mounted on the rotor 1 meets a respectively outer edge 81 of the coupling elements 8 with its truncated cone surface 32, which coupling elements are pressed away from a stop 46 by a pressure spring 45. The coupling elements 8 are pivoted by the lowering of the sleeve 3 with its truncated cone surface 32 onto the respective edges 81 in such a way that the respective outer edge 81 comes to overlap the jacket line 44 of the drive head 4. The elongated part 82 of each coupling element 8 is pivoted in the direction towards the rotary axis 7 against the spring force of pressure spring 45.

The sleeve 3 or rotor 1 is able to slide past the coupling elements 8 during further lowering in the vertical direction until the truncated cone surface 32 rests on a corresponding truncated cone surface 42 of the drive head 4. The truncated cone surface 42 is used as a stop and delimits the downward movement of the rotor 1. In this position the coupling elements 8 can automatically pivot back to their former position, as a result of the spring force of the pressure spring 45 (see FIGS. 1 and 2). The elongated part 82 of each coupling element 8 protrudes beyond the jacket line 44 of the drive head 4, with each coupling element 8 touching the sleeve 3. The coupling elements form a quick-connect coupling, so that the rotor can be connected rapidly and without any tools with the drive head. If users wish to check whether the rotor 1 has been placed on the drive head 4, they can try to pull the rotor 1 upwardly. Since rotor 1 or sleeve 3 rests on the coupling elements 8, an upward vertical displacement is not possible. The user thus recognizes that the rotor is rigidly connected with the drive head 4.

The coupling elements 8 can be detached from the sleeve 3 when an actuating element 10 is moved vertically downwardly along the rotary axis 7 (see FIG. 1). The actuating element 10, which in this embodiment is connected with a resiliently pretensioned pushbutton 11, has a conical end which is able to act upon a coupling tooth 84 of the coupling element 8 (see FIG. 2). The conical end exerts a force perpendicularly to the rotary axis 7, so that the coupling element 8 can be pivoted in such a way until the outer edge 81 comes to overlap again with the jacket line 44 or is displaced even further into the drive head. Rotor 1 can then be pulled upwardly again and be detached from the drive head 4.

Figure 3:
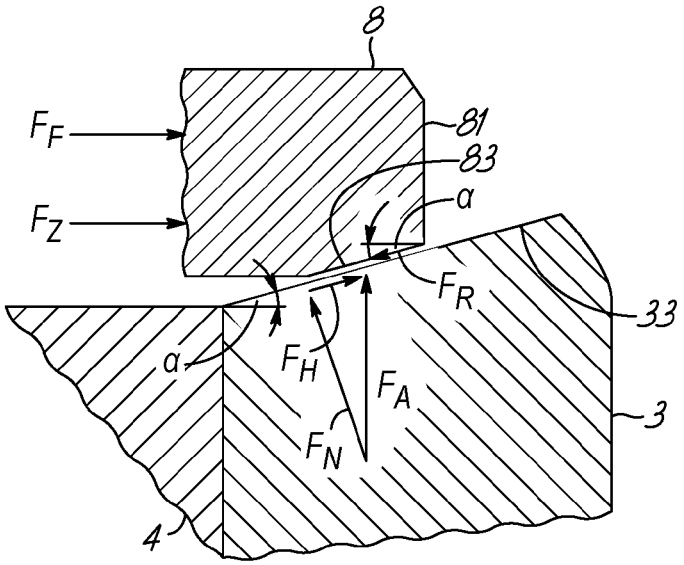
FIG. 3 is an enlarged view of the encircled area 3 in FIG. 1 and shows the forces acting on a coupling element and a sleeve.

FIG. 3 shows a detailed view of the contact of the coupling element 8 with the sleeve 3. The coupling element 8 has a ramp surface 83 which is inclined at an angle $\alpha$ relative to the horizontal line and which is generally planar in cross-section as shown in FIG. 3. The ramp surface 83 touches the corresponding ramp surface 33 of the sleeve 3 in an interlocking manner, which is also inclined at an angle $\alpha$ relative to the horizontal line. The coupling element 8 and the sleeve 3 each form a wedge body as a result of the ramp surfaces 33, 83. If a lifting force $F_A$ acts upon the rotor 1 or sleeve 3 as a result of a high rotary speed, the reaction forces shown in FIG. 3 will be obtained on the surface pair 33, 83 during the cooperation with a coupling element 8. A normal force $F_N$ acts perpendicularly to the ramp surface 33 on the coupling element 8, with a holding force $F_H=F_N*\mu_0$ acting, with $\mu_0$ being the coefficient of friction. The holding force $F_H$ is counteracted by a restoring force $F_R$ of the coupling element 8. The coupling element 8 cannot be pivoted laterally as a result of the lifting force $F_A$ when the following relationship is maintained between the angle $\alpha$ and the coefficient of friction $\mu_0$:

$$\alpha < \arctan \mu_0$$

At a coefficient of friction of 0.3, as is present in the pairing of steel/steel with dry surface (friction of solid bodies), the angle $\alpha$ must be smaller than 16.7°. Self-locking also occurs during standstill of the rotor. When the coupling element 8 is pressed to the side by a pressure spring 45, a spring force $F_F$ acts on the coupling element 8 in addition to the holding force $F_H$. A speed-dependent centrifugal force $F_z$ is also added in a rotation of the rotor 1, so that the total holding force $F_{Hges}$ is calculated as follows in a rotating rotor:

$$F_{Hges}=\mu_0*F_A \cos\alpha+F_F \cos\alpha+F_Z \cos\alpha$$

Figure 4:
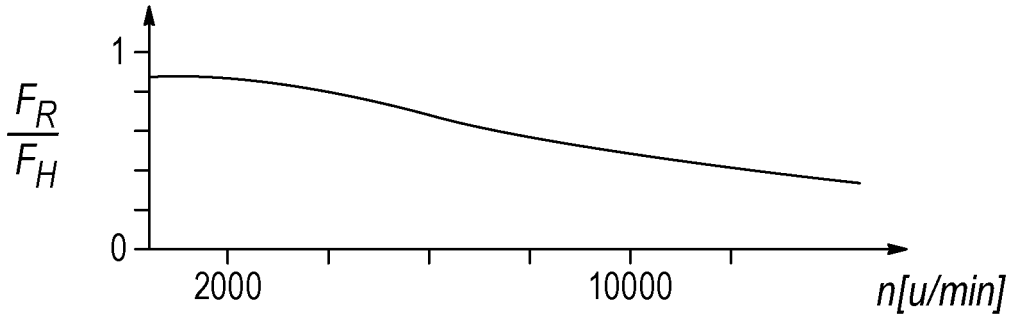
FIG. 4 is a diagram which shows the force ratios depending on the speed of the centrifuge.

It is shown in FIG. 4 how the ratio of $F_R$ to $F_H$ changes depending on the speed n. At a ratio of $F_R:F_H=1$ there is a borderline case in which self-locking is just about achieved. At an angle $\alpha=15°$, the ratio of $F_R:F_H$ is less than 1 in the pairing of materials as chosen here with a coefficient of friction of 0.3 each (see FIG. 4). With increasing speed the amount contributed by the centrifugal force will increase, so that the ratio of $F_R:F_H$ will decrease with rising speed n. The locking of the rotor will thus become more secure with increasing speed.

Figure 5:
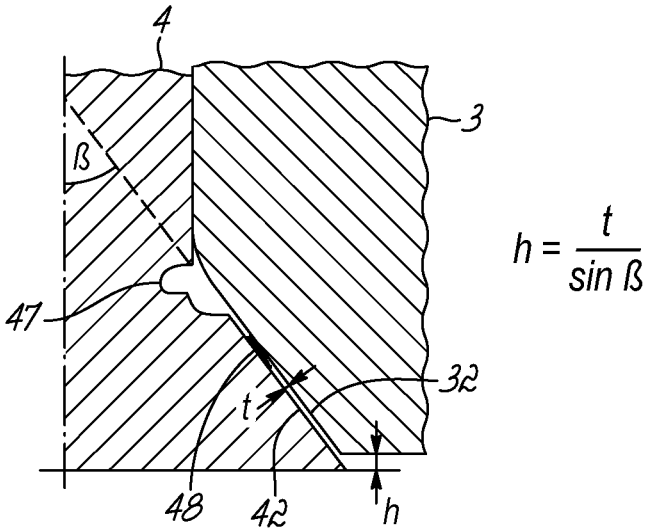
FIG. 5 is an enlarged view of the encircled area 5 in FIG. 1 and shows a soiled drive head and the sleeve of the centrifuge.

FIG. 5 shows a detail in the region of the contact between the drive head 4 and the sleeve 3. The drive head 4 has an accumulation of dirt 48 of thickness t in the region of the truncated cone. When the sleeve 3 or rotor 1 is lowered, the truncated cone surface 32 of the sleeve no longer reaches the truncated cone surface 42 of the drive head 4, but remains at a height which is higher by the amount h than if no dirt accumulation were present. The sensitivity to such an accumulation of dirt is lower the larger the truncated cone angle $\beta$, since thus the difference in height to be bridged by the coupling elements between a clean and dirty cone will become smaller. Since the available space for the movement of the coupling elements 8 is limited and one can assume a dirt accumulation of a maximum of 0.5 mm, the truncated cone angle is approx. 35° in this embodiment.

The influence of dirt accumulation on the cylinder surface 41 can be kept at a low level when recesses 47 are provided in the region of the truncated cone surface 42 of the drive head. They will receive an accumulation of dirt disposed in the region of the cylinder surface 41 during the lowering of the sleeve 3 and will prevent that it will accumulate additionally on the truncated cone surface 42.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicant's invention.

What is claimed is:

1. A centrifuge, comprising:

a drive head configured to be connected with a drive;

a rotor configured to be detachably mounted on the drive head;

at least one connection element configured to connect the drive head in a torsion-proof manner with the rotor; and at least one coupling element attached to the drive head and configured to exert an axial force on the rotor so that the rotor is fixed axially, with the axial force increasing with a rising rotational speed of the drive head, wherein the coupling element on the rotor transmits the axial force via a ramp surface on the coupling element which is generally planar in cross-section and is inclined in a radially outwardly and upwardly direction at an angle relative to a horizontal line in a range of more than 0° to 15° when the drive head is connected to the rotor, wherein the drive head has a jacket surface which comprises a cylinder surface and a truncated cone surface, with the jacket surface engaging a corresponding holding surface associated with the rotor having a cylinder surface and a truncated cone surface when the rotor is mounted to the drive head, with the cylinder surface of the drive head having a length which is at least one quarter of the length of the holding surface, and further wherein the cylinder surface of the drive head is exclusively used for guiding the rotor in axial direction, and the surface of the truncated cone of the drive head is used as a stop surface in the axial direction during placement of the rotor on the drive head.

2. The centrifuge of claim 1, wherein the coupling element is configured to be pivoted around a swivel axis between a release position in which it is pivoted inwardly into the drive head to release the rotor with respect to the drive head, and a locking position in which the coupling element protrudes with the ramp surface from a first jacket surface of the drive head and transmits an axial force onto the rotor so that the rotor is locked with respect to the drive head.

3. The centrifuge of claim 2, wherein the coupling element is resiliently pretensioned so that it assumes the locking position during standstill of the rotor.

4. The centrifuge of claim 2, wherein the connection element is arranged in the swivel axis of the coupling element so that the drive head is configured to be connected with the rotor in a torsion-proof manner.

5. The centrifuge of claim 1, wherein the coupling element comprises a coupling tooth which is configured to cooperate with an actuating element in such a way that a pivoting movement can be exerted on the coupling element, so that a displacement of the coupling element from the locking to the release position or vice-versa can be performed.

6. The centrifuge of claim 5, wherein the actuating element is arranged in a rotary axis of the centrifuge and is conically shaped at one end so that during the axial displacement of the actuating element, the conical end interacts with the coupling tooth of the coupling element.

7. The centrifuge of claim 1, wherein the axial force acts upon a sleeve which is fixedly mounted on the rotor.

8. The centrifuge of claim 1, wherein the truncated cone surface of the drive head has a cone angle of 15° to 40° relative to the rotary axis of the centrifuge.

9. The centrifuge of claim 1, wherein the cylinder surface or the truncated cone surface of the drive head comprises at least one recess.

10. The centrifuge of claim 9, wherein the at least one recess comprises a transversal groove.

11. The centrifuge of claim 1, wherein the cylinder surface of the drive head is arranged as a clearance fit in relation to the holding surface of the rotor or the sleeve, which clearance fit ensures a secure guidance of the rotor during standstill and at high rotational speed.

* * * * *